US012209833B2

(12) United States Patent
Farley, Jr. et al.

(10) Patent No.: US 12,209,833 B2
(45) Date of Patent: Jan. 28, 2025

(54) POCKET PISTOL WITH TWO TRIGGERS

(71) Applicants: James Shelton Farley, Jr., Oklahoma City, OK (US); James Shelton Farley, III, Oklahoma City, OK (US); Michael Alan Farley, Edmond, OK (US)

(72) Inventors: James Shelton Farley, Jr., Oklahoma City, OK (US); James Shelton Farley, III, Oklahoma City, OK (US); Michael Alan Farley, Edmond, OK (US)

( * ) Notice: Subject to any disclaimer, the term of this patent is extended or adjusted under 35 U.S.C. 154(b) by 94 days.

(21) Appl. No.: 18/093,639

(22) Filed: Jan. 5, 2023

(65) Prior Publication Data

US 2023/0213293 A1 Jul. 6, 2023

Related U.S. Application Data

(60) Provisional application No. 63/361,555, filed on Jan. 5, 2022.

(51) Int. Cl.

| | |
|---|---|
| ***F41A 3/58*** | (2006.01) |
| ***F41A 3/66*** | (2006.01) |
| ***F41A 19/10*** | (2006.01) |
| ***F41A 19/20*** | (2006.01) |
| *F41A 35/06* | (2006.01) |

(52) U.S. Cl.

CPC ..... *F41A 3/66* (2013.01); *F41A 19/10* (2013.01); *F41A 19/20* (2013.01); *F41A 35/06* (2013.01)

(58) Field of Classification Search

CPC .... F41A 3/58; F41A 19/09; F41A 3/66; F41A 3/60; F41A 19/10; F41A 19/20

See application file for complete search history.

(56) References Cited

U.S. PATENT DOCUMENTS

| | | | | |
|---|---|---|---|---|
| 325,053 | A | 8/1885 | Chuchu | |
| 2,804,709 | A | 9/1957 | Hughel et al. | |
| 3,193,960 | A | 7/1965 | Stevens, Jr. | |
| 3,352,046 | A | 11/1967 | Warner et al. | |
| 4,416,087 | A | 11/1983 | Hillberg | |
| 4,489,515 | A | 12/1984 | Numbers | |
| 4,625,443 | A | 12/1986 | Beretta | |
| 4,722,148 | A | 2/1988 | Walker | |
| 5,421,114 | A | 6/1995 | Bond et al. | |
| 8,495,831 | B1 | 6/2013 | Kohout | |
| 8,950,311 | B2 | 2/2015 | Emde et al. | |
| 9,062,929 | B2 | 6/2015 | Kohout | |
| 2017/0299324 | A1* | 10/2017 | Patel | F41C 3/02 |
| 2023/0408221 | A1* | 12/2023 | Frankel | F41A 3/66 |

OTHER PUBLICATIONS

Pike, Travis; "Best of Pocket Pistols [2022]", retrieved from https://gununiversity.com on Dec. 28, 2022.

Wikipedia; "Derringer"; rerieved on Dec. 28, 2022 from https://en.wikipedia.org.

Wikipedia; "Pepperbox"; rerieved on Dec. 28, 2022 from https://en.wikipedia.org.

Wikipedia; "Pocket Piston"; rerieved on Dec. 28, 2022 from https://en.wikipedia.org.

* cited by examiner

*Primary Examiner* — J. Woodrow Eldred

(74) *Attorney, Agent, or Firm* — Robert H. Frantz

(57) ABSTRACT

A pocket pistol having at least one barrel in alignment with at least one associated chamber for receiving a firearm cartridge; a barrel release trigger; a double-action firing trigger; and a frame carrying the at least one barrel, the barrel release trigger, and the firing trigger, and defining a cavity within the frame carrying a hammer set and a firing pin.

17 Claims, 7 Drawing Sheets

POCKET PISTOL WITH TWO TRIGGERS

This non-provisional patent application claims benefit of the filing date of U.S. Provisional Patent Application 63/361,555, filed on Jan. 5, 2022, by James Shelton Farley, Jr., et al. The present invention relates to certain improvements of firearms, and particularly to compact pistols.

FIELD OF THE INVENTION

Background of Invention

Compact pistols include pistols which are designed to be stored in small areas. Pocket pistols are a type of compact pistol which are designed to be small enough, lightweight enough and safe for carrying in a pocket such as a pant pocket or a jacket pocket. Most pocket pistols have a capacity of one to seven rounds, weigh less than 22 ounces, and are smaller than 6.5 inches long by 5 inches high, but some are much smaller and some are larger. Pocket pistols fulfill many roles in personal defense, including but not limited to deep concealment (personal defense, undercover law enforcement, etc.), backup gun (law enforcement, military, etc.), and convenience carry (personal defense).

SUMMARY OF THE EXEMPLARY

Embodiments of the Invention

A pocket pistol is described and illustrated having at least one barrel in alignment with at least one associated chamber for receiving a firearm cartridge; a barrel release trigger; a double-action firing trigger; and a frame carrying at least one barrel, a barrel release trigger, and a firing trigger, and defining a cavity within the frame carrying a hammer set and a firing pin.

BRIEF DESCRIPTION OF THE DRAWINGS

The figures presented herein, when considered in light of this description, form a complete disclosure of one or more embodiments of the invention, wherein like reference numbers in the figures represent similar or same elements or steps.

DETAILED DESCRIPTION OF ONE OR MORE EXEMPLARY EMBODIMENT(S) OF THE INVENTION

The present inventor(s) have recognized that certain needs of users and carriers of small and very small firearms remain unmet. As such, the present invention comprises a pocket pistol for concealed carry on ones person to fulfill some or all of these unmet needs, as will be apparent from the following paragraphs.

Pocket pistols have been desired for personal defense for hundreds of years. The very early designs employed ball and cap ammunition of the time. Advancements in ammunition and manufacturing methods have yielded a variety of double action multi-barreled designs, commonly referred to as Derringer pistols, and archaically referred to as pepper-box pistols.

Perhaps a brief description of double action as it pertains to this instance is useful. Double action for purpose herein references the actions of cocking the pistol to fire and cartridge advancement in the same trigger pull. Specifically in this case, a pistol with fixed barrels, cocking the pistol to fire and barrel selection in the same trigger pull.

Within the last 125 years, two types of double action multi-barreled pistols have become the standard. In both designs an embodiment of a basic ratchet and pawl is employed to mechanically generate barrel selection. Considering two barreled pistols, the indexing ratchet is configured in a radial arrangement. Four-barreled pistol designs position the ratchet in an axial configuration.

The embodiments of the present invention include a new design of a double action multi-barreled pistol using a radially configured ratchet and a unique double action hammer. The main objectives according to at least one embodiment of the present invention are, firstly concealability, as it relates to pistol size, thickness, and weight. Many pocket pistols can be heavy or otherwise viewable in the pocket. Secondly, the pistol should be able to be brought into service quickly, which translates to a pistol design without an external hammer or the use of a muzzle sight. Some known designs with these features can be slow to be brought to bear when drawing down, which the present invention intends to improve. Thirdly, reliability in operation is a must, which translates into mechanical simplicity. The compact nature of known double action pocket pistols often results in design complexities, which affect reliability negativity.

Turning to the figures according to at least one embodiment of the present invention, its components, the pistol frame and interworking components may be viewed. The external shape according to at least one embodiment of the present invention is generally rectanctular, like a deck of playing cards, wallet or cell phone, such that it "prints" (e.g., produces a shape on the outside of a cloth garment when carried in a pocket) with a shape other than that resembling a traditional L-shape of a pistol. This enhances its concealability.

Figure 1:
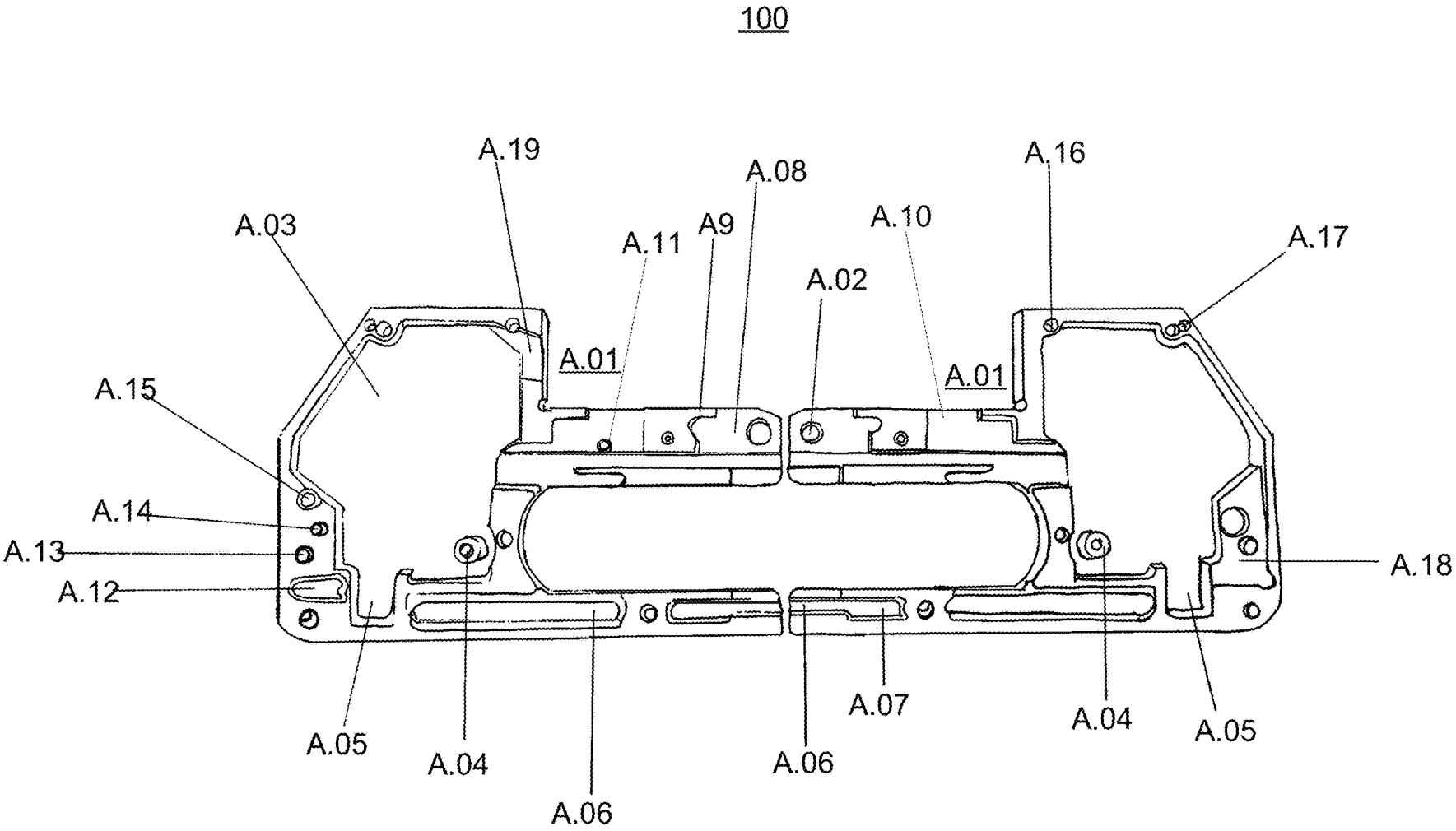
FIG. 1 provides a photograph of an open view of both halves of a pistol frame according to at least one embodiment of the present invention.

Referring now to FIG. 1, a photograph 100 is provided of an open view of both halves which comprise the Pistols' Frame according to at least one embodiment of the present invention such that integral features of the frame may be viewed and considered. Table 1 sets forth reference designators corresponding to frame elements and components, whether separately provided or integrally formed into one half or both halves of the frame:

TABLE 1

| Frame Components and Elements | |
|---|---|
| Reference Designator | Component or Element |
| A.01 | Barrel Relief |
| A.02 | Barrel Attachment |
| A.03 | Hammerset Relief |
| A.04 | Hammerset Pivot Boss |
| A.05 | Main Spring Cavity |
| A.06 | Trigger Raceway Slot |
| A.07 | Spring Containment Pocket |
| A.08 | Barrel Pivot Relief |
| A.09 | Barrel Pivot Stop Engagement |
| A.10 | Barrel Latch Relief |
| A.11 | Barrel Trigger Stop Boss |
| A.12 | Pawl Spring Slot |
| A.13 | Pawl Limit Pin |
| A.14 | Pawl Attachment Hole |
| A.15 | Pawl Pivot Boss |
| A.16 | Frame Attachment Holes |
| A.17 | Frame Alignment Holes |
| A.18 | Pawl Relief |
| A.19 | Firing Pin Relief |

Figure 2:
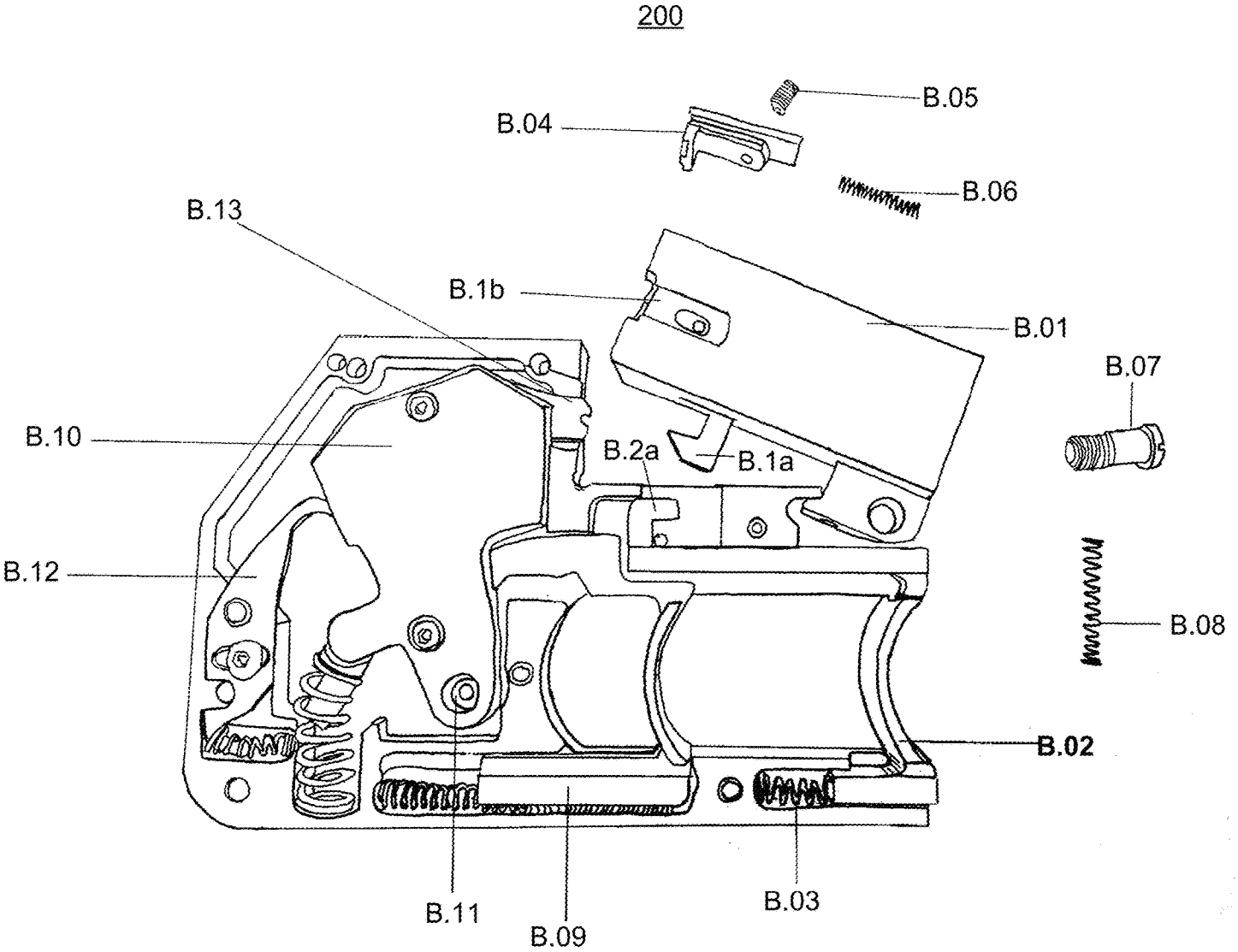
FIG. 2 provides a photograph according to at least one embodiment of the present invention with a semi-assembled view of the pistol's left side frame.

Referring to FIG. 2 shows a photograph 200 according to at least one embodiment of the present invention with a semi-assembled view of the pistol using the left side frame. The reader may notice a macro view of the pistol in order to get a general view of the components and their relationships with each other. Table 2 sets forth reference designators corresponding to elements and components, whether separately provided or integrally formed into the left half the frame:

TABLE 2

| Components and Elements of Semi-Assembled Left Side of Frame | |
|---|---|
| Reference Designator | Component or Element |
| B.01 | Barrel Set |
| B.02 | Barrel Trigger |
| B.03 | Barrel Trigger Spring |
| B.04 | Extractor |
| B.05 | Extractor Set Screw |
| B.06 | Extractor Spring |
| B.07 | Barrel Attachment Screw |
| B.08 | Barrel Tilt Spring |
| B.09 | Firing Trigger |
| B.10 | Hammerset |
| B.11 | Hammerset Pivot Boss |
| B.12 | Pawl |
| B.13 | Firing Pin |
| B.1a | Barrel Lock Projection |
| B.1b | Extractor Slot |
| B.2a | Barrel Trigger Lock Projection |

Figure 3:
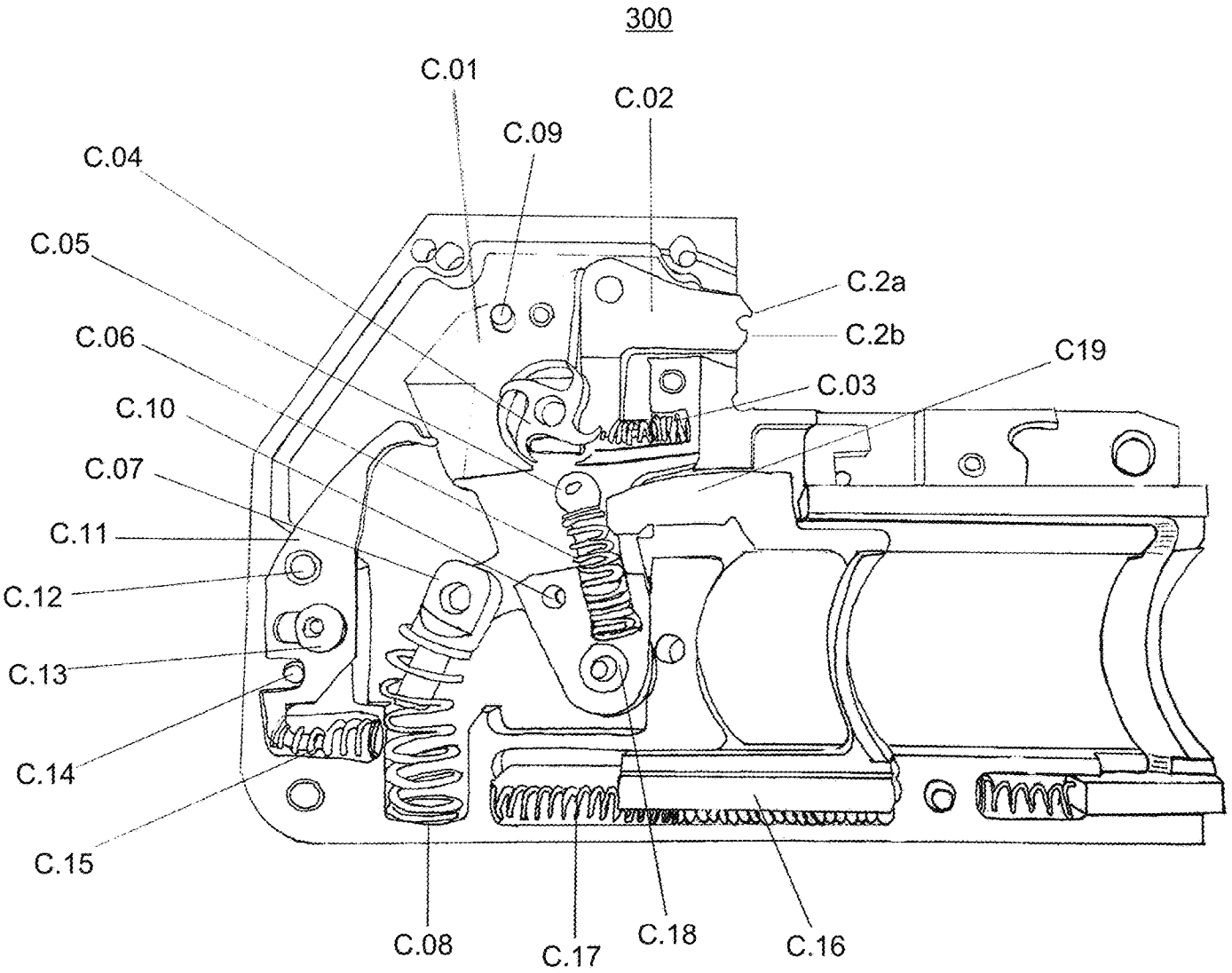
FIG. 3 provides a photograph according to at least one embodiment of the present invention of an open view of the left side Hammer Set and internal assemblies contained therein FIG. 4 provides a photograph according to at least one embodiment of the present invention of an open view of Hammer Set Frames.

Referring now to FIG. 3 shows a photograph 300 according to at least one embodiment of the present invention of an open view of the left side Hammer Set and internal assemblies contained therein. Table 3 sets forth reference designators corresponding to elements and components, whether separately provided or integrally formed into the left half the frame:

TABLE 3

| Components and Elements of Left Side Hammerset and Internal Assemblies Therein | |
|---|---|
| Reference Designator | Component or Element |
| C.01 | Hammerset |
| C.02 | Firing Pin |
| C.03 | Firing Pin Spring |
| C.04 | Ratchet |
| C.05 | Ball Sear |
| C.06 | Ball Sear Spring |
| C.07 | Hammerset Spring Pivot |
| C.08 | Hammerset Main Spring |
| C.09 | Hammerset Alignment Pin |
| C.10 | Hammerset Attachment Holes |
| C.11 | Pawl |
| C.12 | Pawl Pivot Boss |
| C.13 | Pawl Attachment Screw |
| C.14 | Pawl Limit Pin |
| C.15 | Pawl Return Spring |
| C.16 | Firing Trigger |
| C.17 | Firing Trigger Spring |
| C.2a | Upper Barrel Striker |
| C.2b | Lower Barrel Striker |
| C.18 | Hammerset Pivot Boss |

Figure 4:
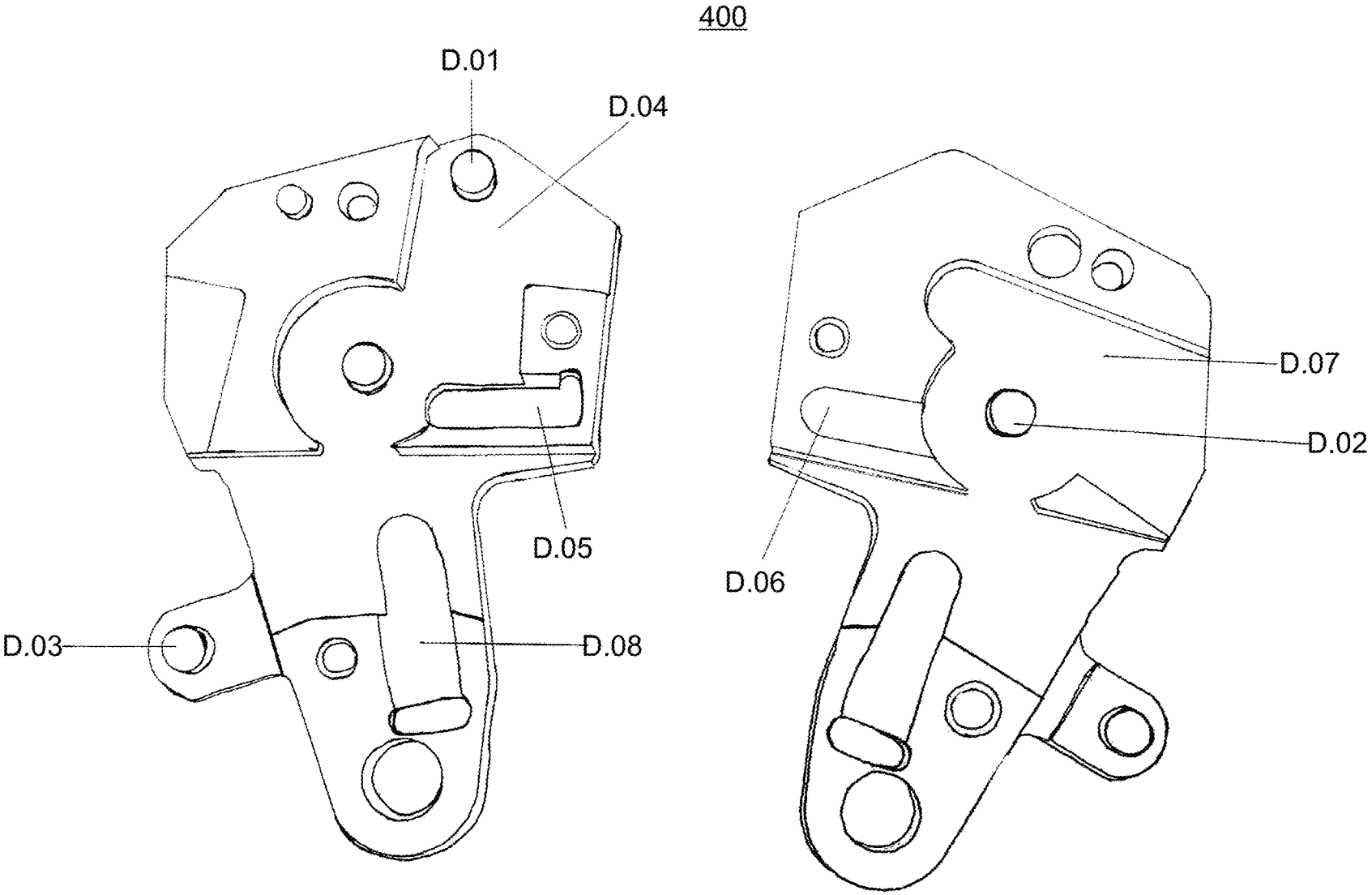

Referring now to FIG. 4 (was Figure D) shows a photograph 400 according to at least one embodiment of the present invention of an open view of Hammer Set Frames. Table 4 sets forth reference designators corresponding to elements and components, whether separately provided or integrally formed into the left half the frame:

TABLE 4

| Hammer Set Frames | |
|---|---|
| Reference Designator | Component or Element |
| D.01 | Firing Pin Pivot Boss |
| D.02 | Ratchet Pivot Boss |
| D.03 | Spring Pivot Boss |
| D.04 | Indexing Engagement Relief |
| D.05 | Firing Pin Spring Cavity |
| D.06 | Firing Pin Spring Relief |
| D.07 | Pawl Relief Clearance |
| D.08 | Ball Track |

Figure 5:
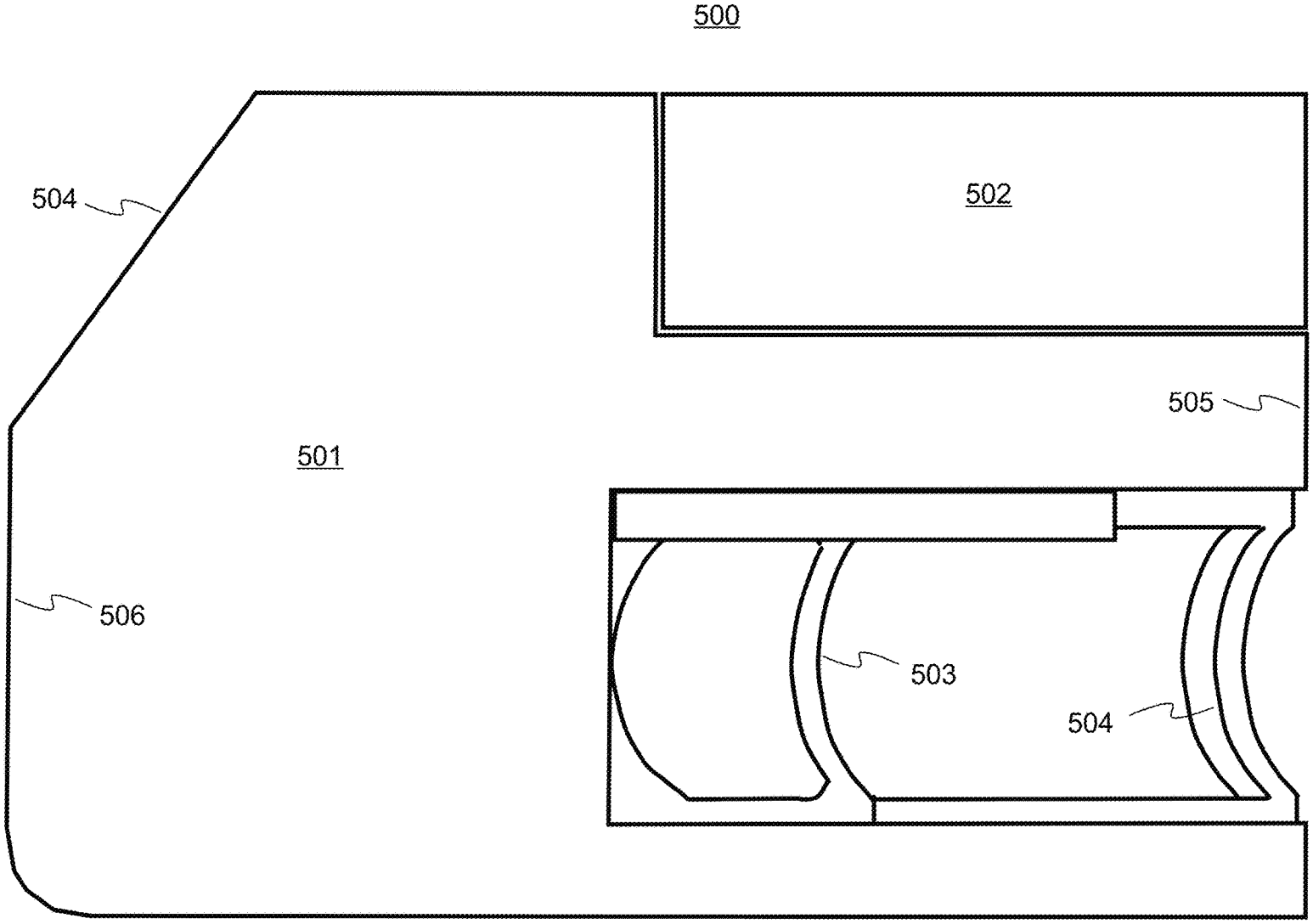
FIG. 5 illustrates an outside view of an assembled pistol according to at least one embodiment of the present invention "in battery" configuration.

Turning now to FIG. 5 (new), an outside view 500 from the right side of the pistol is shown in its assembled condition, thus hiding the internal components as shown in FIGS. 1-4, except for the barrel release trigger 504 and the firing trigger 503, both of which are biased by springs towards the front 505 of the firearm and are slidably operated towards the rear 506 of the firearm. The two barrels 502 are shown in this embodiment in an over-and-under configuration in a latched down ("in battery") condition. The larger area 501 of the side panel serves partially as a grip, and the angled edge 504 serves as a form of a tang, as will be seen in subsequent drawings.

Figure 6:
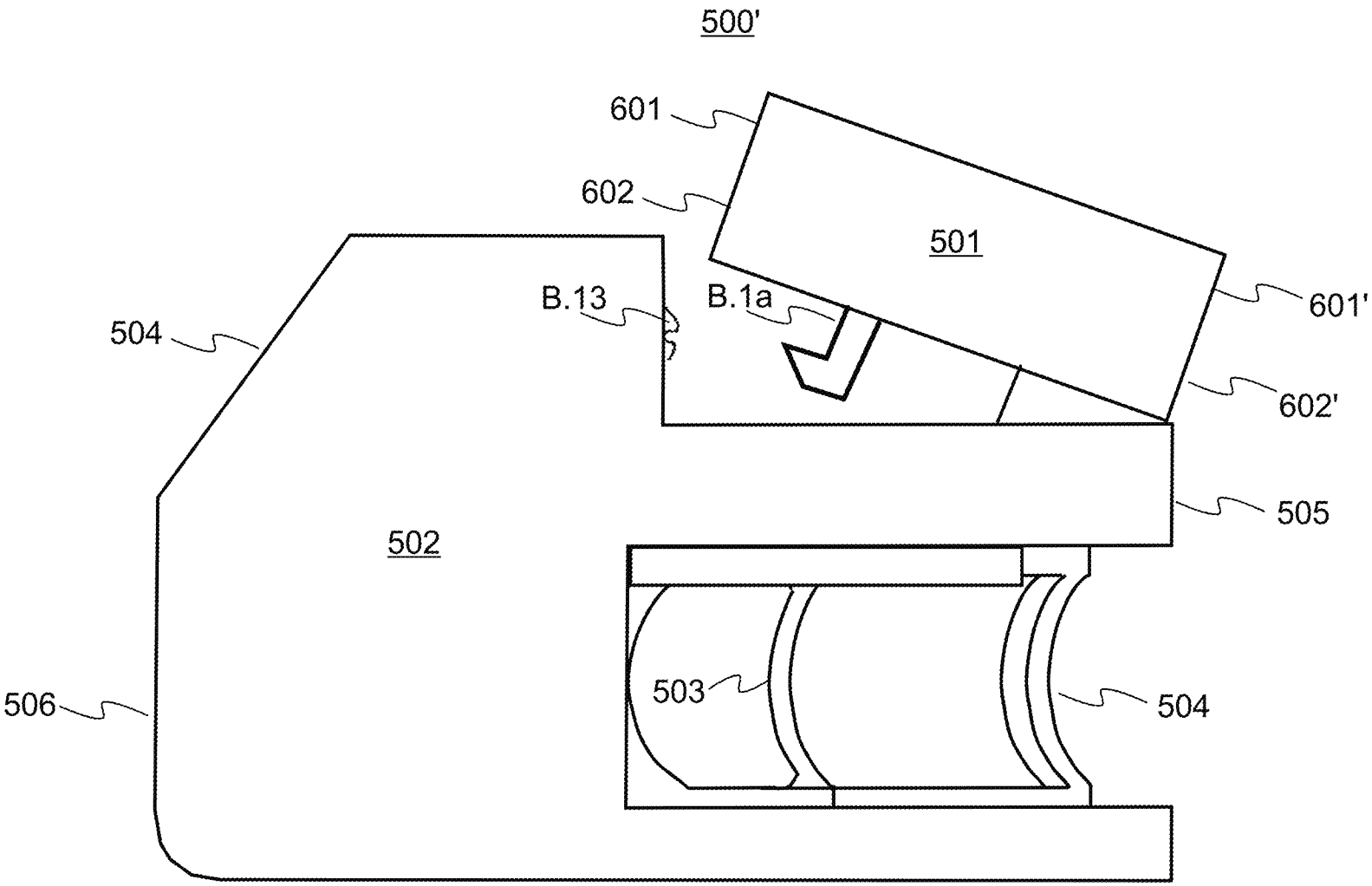
FIG. 6 illustrates an outside view of an assembled pistol according to at least one embodiment of the present invention "out-of-battery" configuration for loading and unloading cartridges.

Referring to FIG. 6, the same view of FIG. 5 is presented, however, the barrel release trigger 504 has been operated by sliding it towards the rear 506 of the pistol, thereby causing the internal components to release the barrels 501 to allow them to be tilted upward into a loading and unloading configuration 500'. In this out-of-battery configuration, the two chambers 601 and 602, which are linearly aligned through the bores of the barrels (hidden from view) with the two corresponding muzzles 601' and 602', can be accessed to load fresh (unspent) cartridges or unload (spent) cartridges from the pistol.

Figure 7:
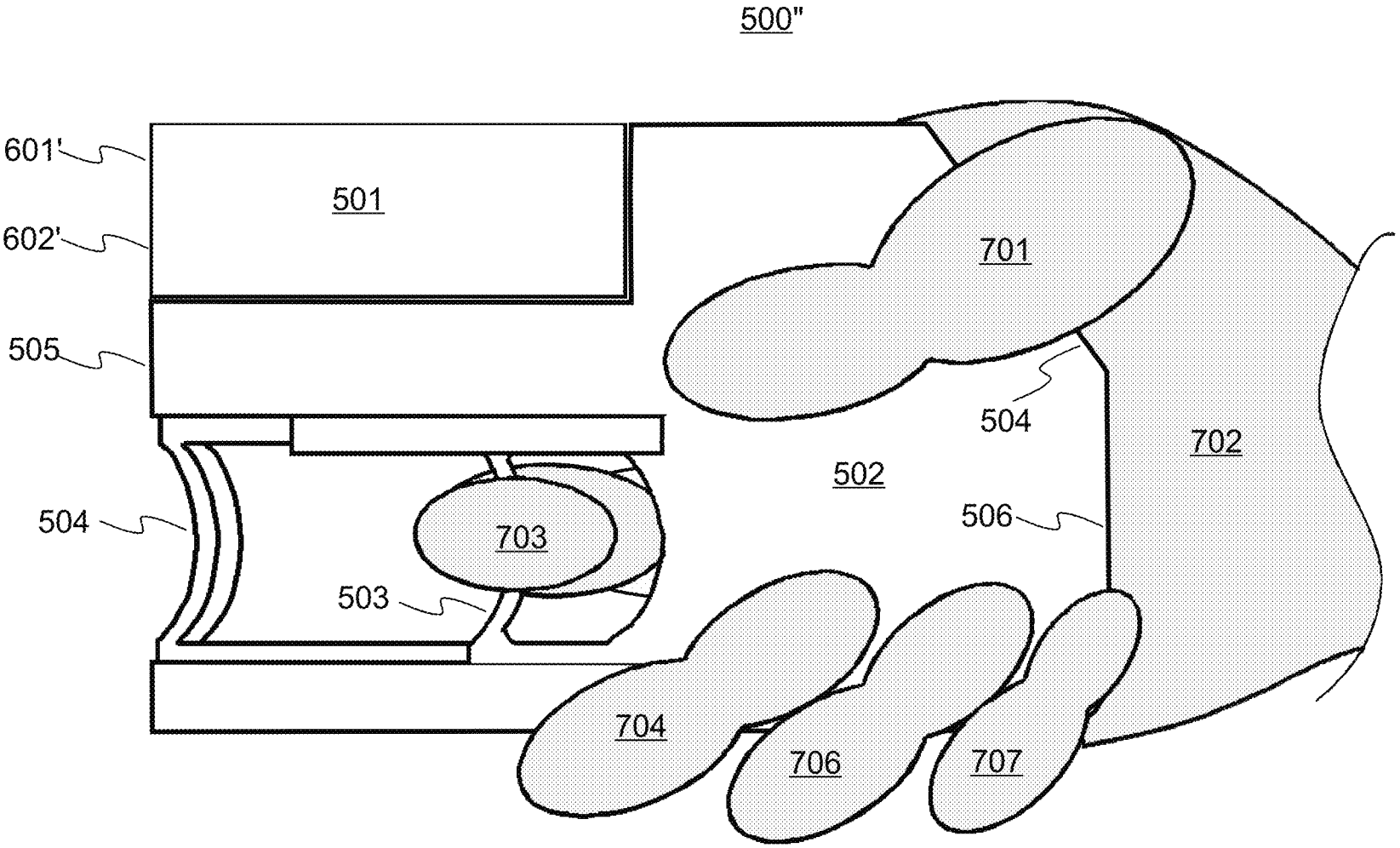
FIG. 7 shows a simulated manner of use by a holder of a pistol according to at least one embodiment of the present invention.

Referring to FIG. 7, a configuration of the pistol as being held 500" by a user is shown, in which the user's hand is shown in gray. The rear edge 506 is received into the palm 702 of the user, and the tang portion 504 receives the user's thumb 701 folded over it. The user's middle, ring, and little (pinky) fingers 704, 706 and 707 are wrapped around the bottom edge of the pistol, thereby securing it into the user's hand and allowing for the firing trigger 703 and barrel release trigger 504 to be selectively operated by the user's first or pointing finger 703.

Returning to FIG. 1, the internal details of the pistol frames both left and right may be viewed. The viewer may notice that each frame is of Monobloc construction. Manufacturing the frames in halves, presents a dual cavity mono bloc concept. The resultant design renders a set of pistol frames with almost all features for fastening, limiting, pivoting, aligning and spring bias to be integral in the frames construction. Viewing the Frames open face, without internal components, as in FIG. 1, all internal features may be viewed. The reader will first see cut-away section A.01 for barrel set placement and provision for barrel set attachment screw at muzzle end A02. The reader will then notice the main frame cavity at A.03 to house the pistol's hammer set. The reader will then see means for Hammer Set rotation in integral boss projections at A.04. The reader may then notice the adjoining slot at A.05 to contain and align the Hammer Set mainspring.

The reader may then observe the linear raceway slots at A.06 to provide guiding means for both firing and barrel release triggers. Accompanying slots to house both triggers' springs may be found at A.07. The reader may then turn to view relief surface for Barrel pivot at A.08. The reader will observe internal ledge at A.09 to serve as limiting surface for barrel set in open position. The reader may then recognize relief cavity for barrel set lockup engagements at A.10. The integral boss at A.11 serves to limit the travel of the barrel release trigger.

The reader may then turn to the slot at A.12 to notice provision for pawl spring containment. Accompanying pawl features at A.13, A.14, and A.15 bring service to limiting pin, attachment hole, and pivot bushing, respectively. Lastly the reader may notice the frame-to-frame attachment holes at A.16, accompanying alignment pin holes at A.17, and pawl relief at A.18.

Returning to FIG. 2, the pistol may be seen in semi-assembled view. The reader may notice the hinged Barrel Set at B.01 to be an over and under configuration that pivots at terminal muzzle end. The reader may then observe the threaded hinge bolt at B.07 for securing the barrel to the frames and notice the previously encapsulated spring at B.08 to provide for barrel tilt. The barrel trigger B.02 may be viewed, and the reader may notice latch locking surfaces at B.2*a* and B.1*a*. Further observation would reveal that as the barrel latch surfaces make contact to lock, the angular latch on the barrel set drives the barrel trigger latch rearward to contact the firing trigger blade pushing it back slightly into the Hammer set subsequently pushing the firing pin back to allow for an unobstructed lock up. Barrel trigger actuation spring may be viewed at B.03.

In FIG. 2, the extractor B.04 for the Barrel set may be observed. The extractor is lineally guided in extractor T-slot referenced at B.1*b*, held in place by set screw at B.05, with extractor spring at B.06 to provide spring bias. The general relationship of the primary firing components can be viewed where Firing Trigger at B.09 engages internally with Hammer Set at B.10, as Pawl at B.12 provides for ratchet index with protected internal engagement from the rear.

Returning to FIG. 3, the Hammer Set arrangement may be viewed as exposed. Left side Hammer Set frame may be viewed at C.01. C.02 represents the firing Pin with firing pin index spring at C.03 to provide bias. The reader will notice independent striker surfaces at C.2*a* and C.2*b* for the top and bottom cartridges, respectively. The Ratchet to actuate barrel selection may be seen at C.04. When engaged by the Pawl at C.11, during Hammer Set rotation, the ratchet indexes about its center to present two alternating surface engagements to the Firing Pin. These engagement surfaces serve to change the angularity of the Firing Pin using reciprocating motion, aligning each Striker surface to its respective cartridge with successive pulls of the trigger. Pawl attachment screw can be viewed at C.13, pivot bushing at C.12 and limiting pin at C.14. Pawl return spring may be viewed at C.15.

Firing Trigger C.16 and its engagement with the Hammer Set at C.01 is shown in FIG. 3. Depression of the trigger forces Firing Trigger Blade at C.19 into contact with previously encapsulated Hammer Set ball at C.05. Please note that Hammer Set Ball at C.05 is not shown in lowered position due to design constraints.

Continued depression acts to start Hammer Set rotation centered on Hammer Set Pivot Boss at C.18 and begin compression of Hammer Set ball C.05 and Ball Spring at C.06. Simultaneously, Spring Pivot at C.07 and Hammer Set Main Spring at C.08 also begin to compress.

Please note also that Spring Pivot at C.07 in this example embodiment is represented as a rotating link which also serves to pilot in the spring. This embodiment has since proven to produce undesirable drag and has been changed to a ball engagement for main spring compression. The new embodiment provides multidirectional compression of spring bias, as well as assists in generating a focused and free transmission of energy release.

Further depression adds the contact of engagement surfaces of the Pawl at C.11 and Ratchet at C.04. Complete Firing Trigger depression brings Hammer Set Ball and Firing Trigger Blade to terminal arc end of rotation with simultaneous completion of Ratchet index rotation at C.04. Hammer Set release is achieved as Hammer Set Ball descends beneath the Firing Trigger Blade at terminal arc end releasing compressed Hammer Set Main Spring at C.08, allowing rotation and subsequent pistol firing. Firing Trigger reset is provided for via Firing Trigger Spring at C.17.

Returning now to FIG. 4, the reader will view the Hammer Set frames in open, empty condition. The reader will notice the Hammer Set Frames to also be of dual cavity mono bloc construction. The integral pivot boss at D.01 serves to position the Firing Pin and also as a hinge point. The integral Pivot Boss at D.02 to locate and provide for Ratchet rotation. The integral pivot boss at D.03 provides for Spring Pilot anchor and rotation.

Please note that the integral pivot boss at D.03 has been removed and changed to a spherical pocket to captivate said ball for improved embodiment at spring engagement C.07.

Indexing engagement relief may be viewed at D.04 with adjoining spring pocket at D.05. D.06 represents spring relief as D.07 provides clearance relief for the Pawl. D.08 represents both the pocket for the ball spring and the track for the Hammer sets' ball. D.09 is clearance relief for the firing trigger blade.

As such, the the detailed and described embodiment of the foregoing paragraphs discloses a pocket pistol design with an over under barrel configuration, using two triggers: a fore-mounted trigger which actuates barrel release (but which does not fire a round), and a rear mounted trigger which fires the cartridges (one pull per round fired). Both Pistol Frame halves and the Hammer Set are of dual cavity Monobloc construction. The Pistol is Double Action. The Pistol incorporates an enclosed, radially configured, ratchet to provide for the action of barrel selection. The presented embodiment employs a Ball and Blade Sear for the action of Cocking and firing.

The present invention provides one or more unique features, functions and elements not incorporated in other pocket pistol designs, which when embodied individually or in combination, meet several previously-unmet needs in the art. The first design element that may be viewed as unique to the art is the use of two independent triggers: the fore-mounted trigger for barrel release and the rear mounted trigger for pistol firing. The fore-mounted trigger that provides for barrel release is different from other multi-barrel pistol designs in that most existing designs incorporate a thumb latch to actuate barrel release for reloading. While both designs allow for single hand actuation, the thumb latch design inherently causes a momentary loss of grip while reloading takes place. Our fore-mounted trigger design allows for the thumb to remain in hold position and subsequent gripping force to be maintained while barrel release is actuated and reloading takes place.

Second, embodiments according to at least one embodiment of the present invention eliminate the thumb latch buttons or levers contained in existing designs which often protrude from the pistol's frame, and which create potential hang points that can hinder the user from drawing quick action. This aspect is often twice as evident when ambidextrous controls are present on some models of pocket pistols. Embodiments according to at least one embodiment of the present invention may produce no projections from the sides of the frame to avoid potential hang points as well as being ambidextrous in a single control.

Third, embodiments according to at least one embodiment of the present invention may incorporate our firing pin arrangement and design. Known firing pin designs employed in existing multi-barreled derringer type pistols have traditionally involved two types of striker pin designs. In four barrel designs, as well as two barrel designs, a hammer operating as a secondary unit indexes to make targeted contact with firing pins aligned independently with each barrel. This design is represented as one hammer, multiple striker pins. The other traditional approach has the striker itself to change position in relation to the cartridge. This second traditional design is one hammer, one pin. However, according to at least one embodiment of the present invention, our firing pin arrangement and design presents a striker with two independent contact surfaces to engage the cartridges. The design is one hammer, one pin, but with two engaging surfaces. As such, the present invention allows for the simplicity of the one hammer one pin design, while changing the wear characteristics by distributing the strikes between two different surfaces. This introduced redundancy also increases both reliability and longevity.

Fourth, embodiments according to at least one embodiment of the present invention may incorporate the present invention's firing trigger arrangement and design. The present inventors believe that this pocket pistol invention is the first of its kind to employ a captive ball and blade sear engagement to actuate firing of the pistol. Those skilled in the art understand that two basic types of finger piece trigger embodiments have evolved for use in firearms. The first is the hinged finger piece, allowing for rotation to actuate the firing mechanism. The second embodiment being a linear sliding type finger piece guided in slots or on rails, to provide for linear actuation of the firing mechanism.

However, according to at least one embodiment of the present invention, our pocket pistol is the first of its kind to employ a lineally actuated finger piece without the use of levers to provide for sear engagement and related geometry. The present invention's captivated ball and blade arrangement allows for Bidirectional movement to allow for firing and subsequent reset. Our unique embodiment presented here employs linear firing trigger actuation, represented in the finger piece blade, to work against an angularly captivated ball containing bias. As linear travel of the blade progressively drives the captivated ball and Hammer Set to rotation about their shared hinge point, ball compression is then seen to take place, and as rotation continues, the idea of terminal arc end becomes apparent. As ball track length and firing trigger blade configuration determine the terminal arc end point, the angularity of an over center track arrangement serves to enhance actuation.

The novelty of the Ball and Blade sear engagement according to at least one embodiment of the present invention is accentuated if not defined by the dual-cavity mono bloc construction principles applied in our Hammer Set design. The present inventors believe our Hammer Set design is the first of its kind to employ dual cavity mono bloc construction principles to all engagements contained within. This aspect simplifies both construction and manufacture by creating a Hammer Set design in which location and hinge pins are integral to frames. In addition, the symmetrical halves of our Hammer Set, present dual-cavity mono bloc construction principles as opposed to single cavity mono bloc principles, a considerable advancement over traditional designs. The inherent symmetry of our dual cavity mono bloc construction allows for relationships between actuating members to be centered about one another both radially and axially. Specific embodiments in this instance can be viewed in the relationships between our Pawl, Ratchet, and Firing Pin. The design yields a condition in which the ratchet and pawl action is centered with the cocking action, improving form and function. In addition, all three actions—pawl to ratchet, ratchet to firing pin, and blade to ball—are enclosed, each being protected during respective operation. This design aspect further increases reliability.

Fifth, the dual cavity mono bloc construction according to at least one embodiment of the present invention also allows for location and containment of both symmetrical and non-symmetrical operating elements. Specifically in this instance, our dual cavity design provides for the symmetrical location and containment of the ball and spring bias provision represented in the ball track, as well as the ball engagement for main spring compression represented in the required spherical pocket for the aforementioned improved main spring embodiment. Dual cavity mono bloc construction also provides for non-symmetrical operating elements represented in the location and containment of the firing pin and its spring.

Additional Embodiments. Additional embodiments according to the present invention include, but are not limited to, making some features integral to the pistol frame instead of the hammer set frame, optionally with a combination of dual cavity construction using the exterior surfaces of the hammer set and the interior surfaces of the frame cavity or a combination thereof.

The ball and blade sear design of the present invention may be embodied in a reverse geometric arrangement employing counter-rotation, or rendered in an axial configuration employing a horizontal blade instead of a vertical blade as disclosed in the foregoing embodiment. The number of balls may be increased, and/or additional spherical elements added and and/or the angularity of such features changed to create a similar bi-directional condition of terminal arc end. The ball and blade sear design of the present invention may also be realized with a rotating finger piece for actuation.

The firing pin design of the present invention may be realized in a side-by-side barrel configuration. In addition, embodiments of the present invention may be configured for centerfire cartridge use. Further, embodiments of the present invention may be adapted to employ an independent multiple striker design as well.

The dual trigger design according to the present invention may be realized using a rotating finger piece to actuate barrel release for spent shell ejection and/or loading, as has been achieved in certain shotgun embodiments. It may also be realized to actuate in a parallel arrangement, or, in addition, not represented as a trigger, but a forward barrel release feature accessible by the user's trigger finger that does not stand off from the frame to create a potential hang point.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The foregoing example embodiments do not define the extent or scope of the present invention, but instead are provided as illustrations of how to make and use at least one embodiment of the invention.

What is claimed is:

1. A pistol comprising:

at least one barrel in alignment with at least one associated chamber configured to receive a firearm cartridge;

a first trigger configured to be operated by a user which, when pulled rearwards, releases the at least one barrel to open the at least one associated chamber to remove a spent firearm cartridge or to receive an unspent firearm cartridge;

a second trigger configured to be operated by a user which, when pulled rearwards, performs an double action operation to cock and release a firing pin to fire a firearm cartridge in the at least one chamber; and a frame carrying the at least one barrel, the first trigger, and the second trigger, and defining a cavity within the frame carrying a hammer set and the firing pin;

wherein the first trigger and the second trigger are aligned with each other wherein the first trigger forms a portion of a trigger guard for the second trigger.

2. The pistol of claim 1 wherein the at least one barrel and at least one associated chamber comprises two barrels and two associated chambers.

3. The pistol of claim 1 wherein the first trigger is configured to slide linearly from a front edge of the frame towards a rear edge of the frame.

4. The pistol of claim 1 wherein the second trigger is configured to slide linearly from a front edge of the frame towards a rear edge of the frame.

5. The pistol of claim 1 wherein the frame is of a generally rectangular, flat shape having no protrusions on two flat-faced sides.

6. The pistol of claim 1 wherein the frame comprises two monobloc halves.

7. The pistol of claim 2 wherein the firing pin has two firing surfaces which fire cartridges in the at least two chambers in an alternating operation.

8. The pistol of claim 2 wherein the firing pin, hammer set, and second trigger cooperate during the double action operation to fire a single cartridge per pull of the second trigger, resetting after each pull to fire another single round cartridge on a subsequent pull.

9. The pistol of claim 8 wherein the cooperation comprises an enclosed, radially-configured ratchet to perform barrel selection for firing on the next pull of the second trigger.

10. A method of manufacture of a pistol comprising:

producing a frame defining a cavity within the frame carrying a hammer set and a firing pin;

disposing into or onto the frame at least one barrel in alignment with at least one associated chamber configured to receive a firearm cartridge;

disposing into or onto the frame a user-operable first trigger configured to be operated by a user which, when pulled rearwards, releases the at least one barrel to open the at least one associated chamber to remove a spent firearm cartridge or to receive an unspent firearm cartridge;

disposing into or onto the frame a user-operable second trigger which, when pulled rearwards, performs an double action operation to cock and release the firing pin to fire a firearm cartridge in the at least one chamber; and wherein the first trigger and the second trigger are held by the frame in alignment with each other wherein the first trigger forms a portion of a trigger guard for the second trigger.

11. The method of claim 10 wherein the disposing of at least one barrel and at least one associated chamber comprises disposing two barrels and two associated chambers.

12. The method of claim 10 wherein the first trigger is configured to slide linearly from a front edge of the frame towards a rear edge of the frame.

13. The method of claim 10 wherein the second trigger is configured to slide linearly from a front edge of the frame towards a rear edge of the frame.

14. The method of claim 10 wherein the producing of the frame yields a frame having a generally rectangular, flat shape substantially free of protrusions on two flat-faced sides.

15. The method of claim 10 wherein the producing of the frame comprises producing two monobloc halves.

16. The method of claim 11 wherein the firing pin has two firing surfaces which fire cartridges in the at least two chambers in an alternating operation.

17. The method of claim 11 wherein the firing pin, hammer set, and second trigger cooperate during the double action operation to fire a single cartridge per pull of the second trigger, resetting after each pull to fire another single round cartridge on a subsequent pull.

* * * * *